US006189700B1

(12) United States Patent
Packrall et al.

(10) Patent No.: US 6,189,700 B1
(45) Date of Patent: Feb. 20, 2001

(54) CONVERTIBLE POP-UP DISPLAY STRUCTURE AND SHIPPING CASE CONVERTIBLE TO A PODIUM

(75) Inventors: Timothy Packrall; Andrew Jay Burkette, both of Tampa, FL (US)

(73) Assignee: Stellar Holdings, Inc., Tampa, FL (US)

( * ) Notice: Under 35 U.S.C. 154(b), the term of this patent shall be extended for 263 days.

(21) Appl. No.: 08/777,668

(22) Filed: Dec. 20, 1996

(51) Int. Cl.[7] ..... B65D 5/50

(52) U.S. Cl. ..... 206/736; 206/577; 190/18 A; 150/154

(58) Field of Search ..... 206/736, 764, 206/45.24, 575, 577, 570; 190/26, 18 A, 115; 150/154, 103, 104, 105; 312/4, 5, 6

(56) References Cited

U.S. PATENT DOCUMENTS 4,573,202 * 2/1986 Lee ..... 190/115
5,044,595 9/1991 Carr et al. .
5,494,157 * 2/1996 Golenz et al. ..... 190/115
5,562,189 * 10/1996 Chen ..... 190/115
5,562,229 * 10/1996 Callahan ..... 150/154
5,564,538 * 10/1996 Sadow ..... 190/115
5,680,944 * 10/1997 Rueter ..... 150/154

* cited by examiner

*Primary Examiner*—Paul T. Sewell
*Assistant Examiner*—Shian Luong
(74) *Attorney, Agent, or Firm*—Hodgson, Russ, Andrews, Woods & Goodyear, LLC

(57) ABSTRACT

An expandable framework for attachment of display panels and the like. The linkage is lockable in one or more configurations intermediate the collapsed and fully expanded configurations so that the same framework may be used for more than one type of display, such as floor display and table-top display. A shipping case for containing the framework, when collapsed, is convertible into a podium by wrapping a decorative panel about the case and fastening the panel thereto to be flush with an upper platform on the case.

13 Claims, 6 Drawing Sheets

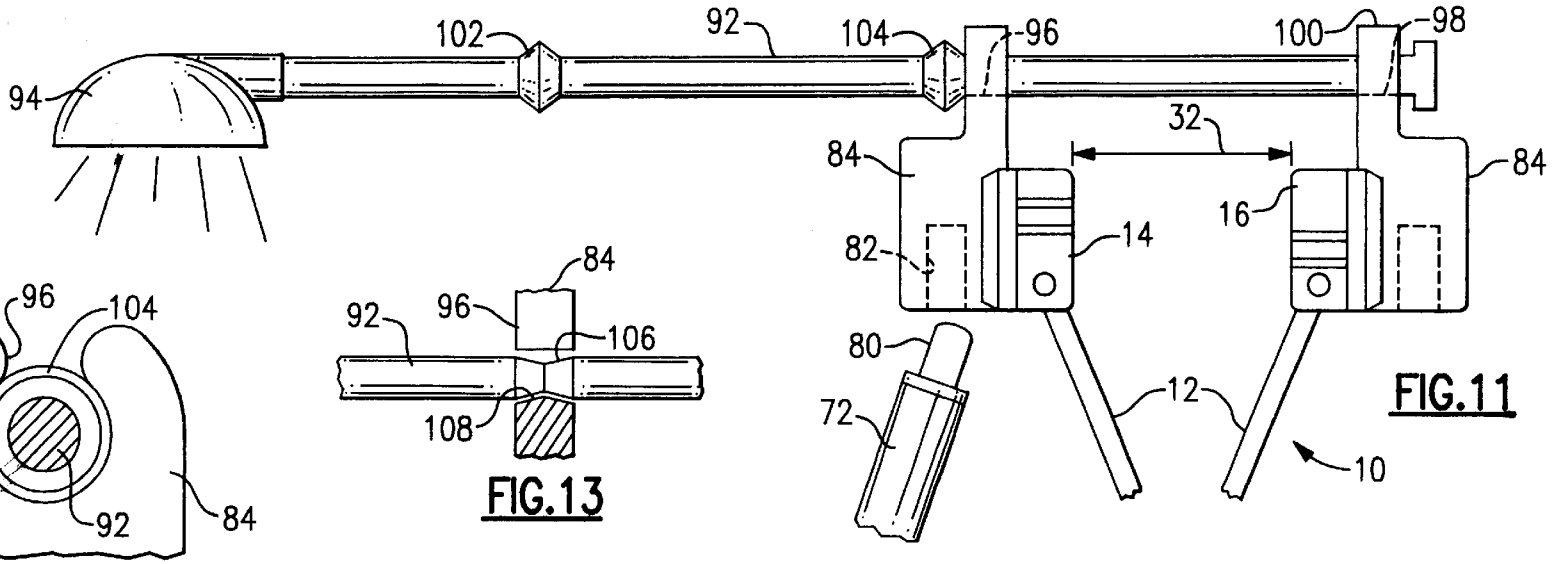
FIG.11
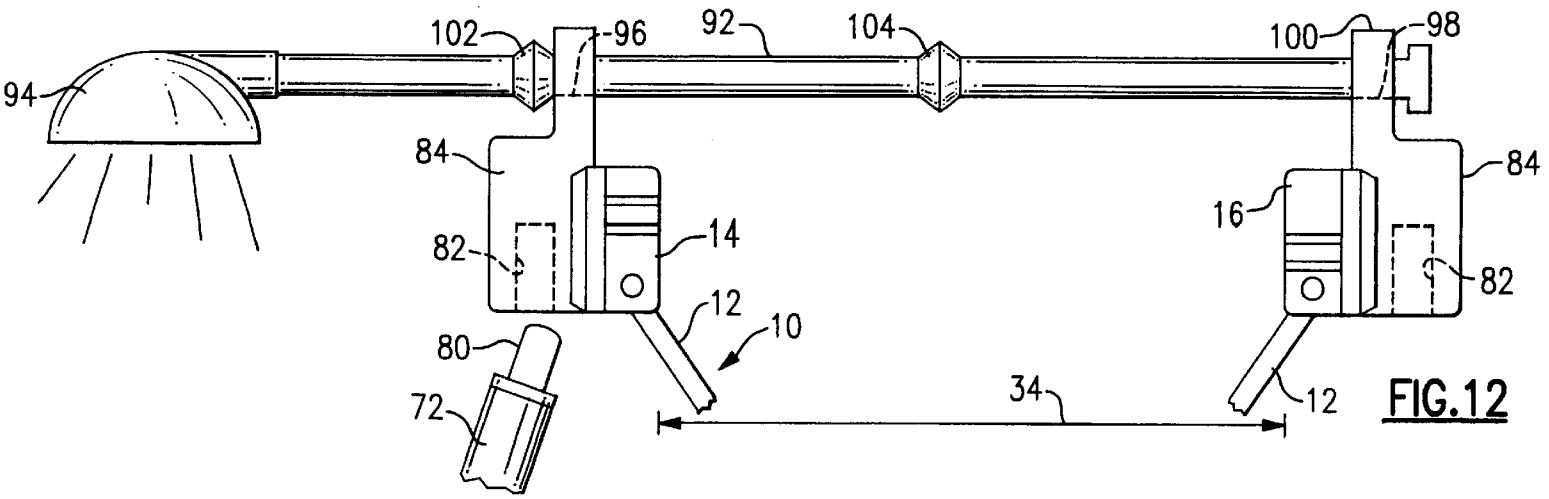
FIG.12
FIG.13
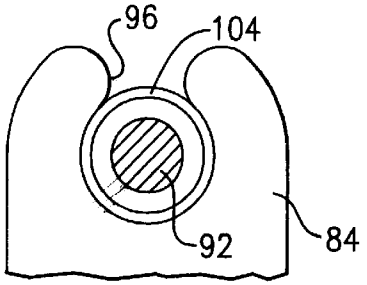
FIG.17

CONVERTIBLE POP-UP DISPLAY STRUCTURE AND SHIPPING CASE CONVERTIBLE TO A PODIUM

The present invention relates generally to expandable folding frame portable display structures, commonly referred to in the industry as "pop-ups", for use in tradeshows, but they may have other purposes.

Examples of such pop-up displays are found in U.S. Pat. Nos. 4,658,560; 4,986,016, 5,125,205; and 4,995,212 which patents are incorporated herein by reference.

Such pop-up displays are available in a variety of either full-height free-standing configurations (such as 10 feet wide curved, 8 feet wide curved, and full-size flatwall) or small table-top configurations (such as 8 feet wide table-top, 6 feet wide table-top, and 6 feet wide flatwall). The full-height displays may have a height of perhaps about 8 feet while the reduced-height table-top displays may have a height, not including a table, of perhaps about 5 feet.

The variety of various pop-up displays on the market utilize various means for holding the frameworks erect in their expanded positions. For example, the aforesaid '560 patent shows at 16 buttons at hubs of its framework to which are attached braces, illustrated at 24 in the '560 patent, for holding the framework in its expanded position, each brace extending between two vertically adjacent hubs. The '016 and '205 patents illustrate another example of holding a framework at an expanded position, i.e., by frame-latching mechanisms, illustrated in FIG. 6 thereof, extending between corresponding front and rear hubs.

It is an object of the present invention to provide a pop-up structure which desirably has versatility for use as more than one version, i.e., such as, for example, a full-height freestanding configuration and a reduced-height table-top configuration.

Both the pop-up display framework, hardware (panel attachment bars), full-size panels for use with the full-height configuration, reduced-size panels for use with the reduced-height configuration, and other components are housed in a wheeled case for storage, shipping, and transport.

It is considered desirable to be able to utilize the shipping case as a podium. Previous efforts to so convert the shipping case have utilized a separate lid or top for hiding or covering up the top of the case and several side pieces or components to visually hide the sides of the case.

It is another object of the present invention to be able to more easily and quickly convert the case to a podium.

In order to provide such a versatile framework, in accordance with the present invention means are provided for locking the linkage in at least one configuration which is intermediate a collapsed configuration and a fully expanded configuration.

In order to convert a shipping case to a podium, in accordance with the present invention a decorative panel is wrapped about the case and is detachably fastened thereto to be flush with a platform thereof.

The above and other objects, features, and advantages of the present invention will be apparent in the following detailed description of the preferred embodiments thereof when read in conjunction with the accompanying drawings wherein the same reference numerals denote the same or similar parts throughout the several views.

BRIEF DESCRIPTION OF THE DRAWINGS

FIG. 11 is a partial schematic view of another embodiment of a framework, erected to a full-height configuration, in accordance with the present invention.

FIG. 12 is a view similar to that of FIG. 11 of the framework thereof erected to a reduced height configuration.

FIG. 13 is a partial schematic view illustrating an alternative embodiment of the light arm of FIG. 11.

FIG. 17 is a sectional view of the light arm of FIG. 11 and illustrating passage of an upset thereon through a light holder yoke.

DETAILED DESCRIPTION OF THE PREFERRED EMBODIMENTS

Figure 1:
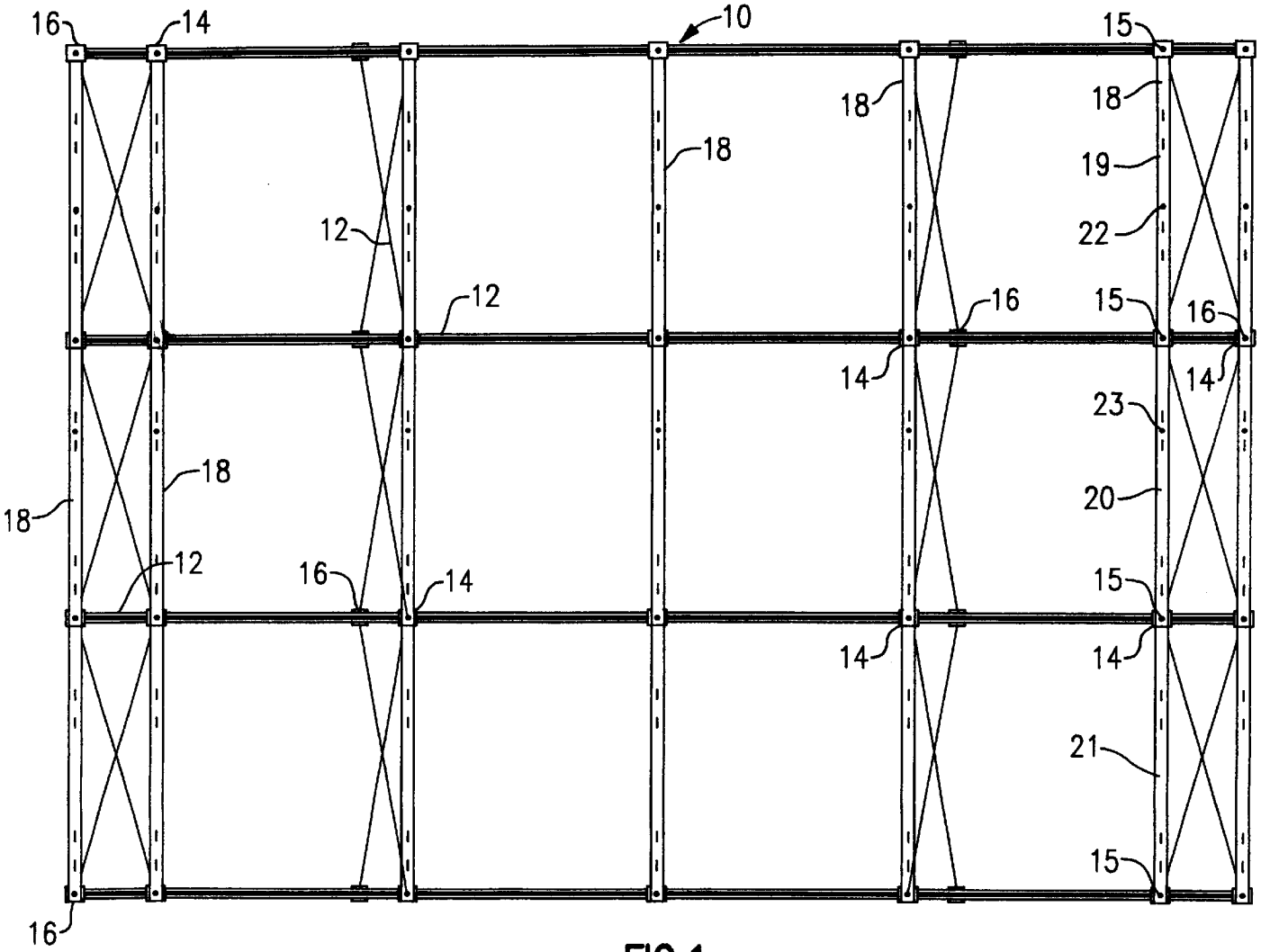
FIG. 1 is a schematic front elevation view of a display framework which embodies the present invention and which is erected to a full-height configuration.
Figure 9:
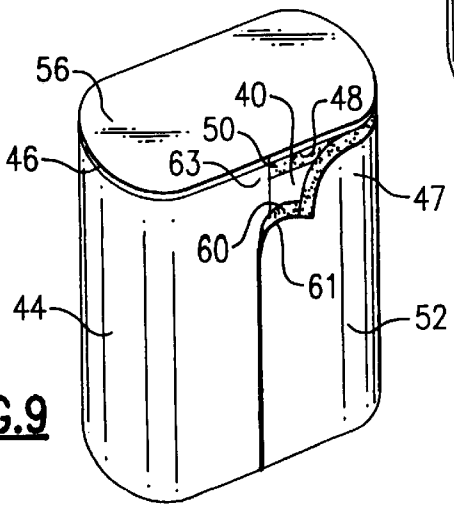
FIG. 9 is a perspective view illustrating conversion of the case into a podium, with a portion of the wrap panel pulled away for illustrative purposes.
Figure 10:
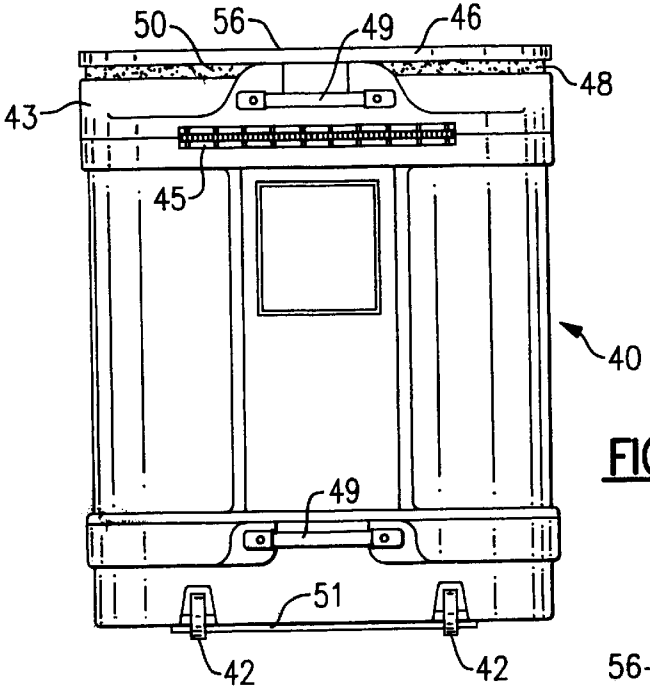
FIG. 10 is a rear elevation view of the case, slightly modified.
Figure 16:
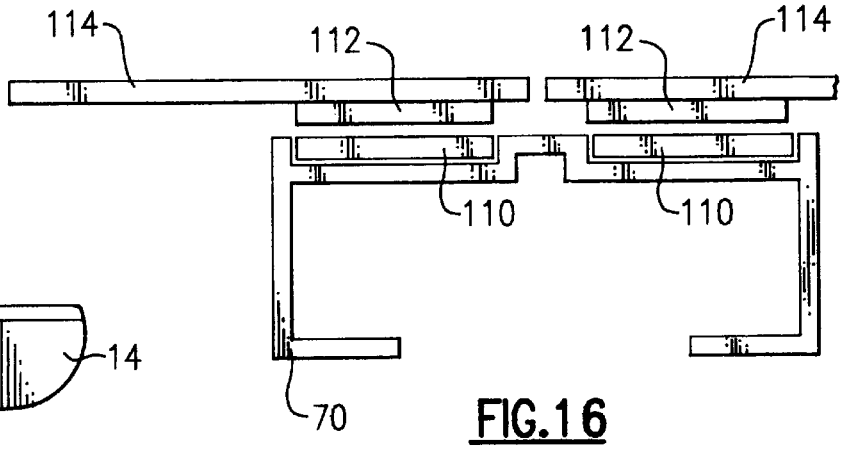
FIG. 16 is a schematic end view of the mag bar of FIG. 14, illustrated unfolded and with attachment of panels thereto.

Referring to FIGS. 1 to 4, there is shown generally at 10 an expandable folding frame portable display unit or pop-up display framework which may be used for supporting cladding or graphics, as illustrated by panels 114 in FIG. 16, covering the framework when it is in use. The display comprises a plurality of linkages 12 which are pivotly connected at front and rear hubs 14 and 16 respectively for expansion from a compact position for storage and transport, such as illustrated in FIG. 9 of the '016 and '205 patents, to a display position, such as illustrated in FIGS. 1 to 4, wherein panels 114 are attached to the front and sides thereof similarly as fabric is illustrated at 70 in FIG. 12 of the '560 patent to be attached to the front of a pop-up framework. Panels may also be attachable to the rear side of the framework. The framework may have open quads, as illustrated, or may have support bracing within quads, such as shown in FIG. 1 of the '560 patent. The framework 10 may be composed of aluminum or other suitable materials.

Figure 2:
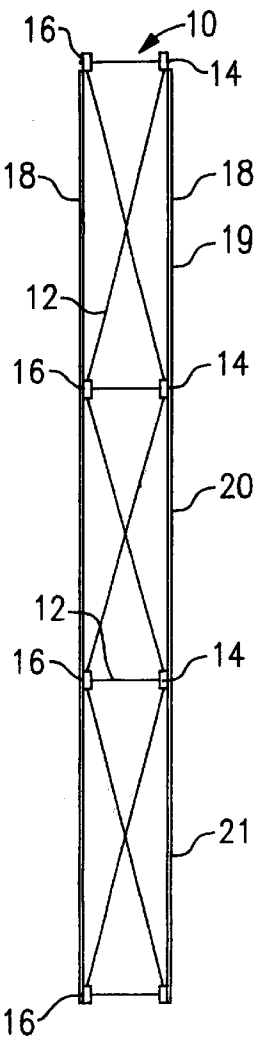
FIG. 2 is a schematic side elevation view thereof.

In accordance with the present invention, braces 18, which may be called channel bars, struts, or mag bars, extend vertically and may be composed of perhaps three foldably connected portions 19, 20, and 21 each of which extends between two vertically adjacent hubs 14 when the framework is in a full-height or fully expanded configuration, as illustrated in FIGS. 1 and 2. At least one end portion of each bar portion 19, 20, and 21 has a suitable hub attachment means, illustrated at 15, for detachable attachment of the bar 18 to the vertically aligned hubs 14 so that the framework height is approximately equal to the length of the bar 18. In addition to holding or locking the framework 10 in the expanded configuration, the mag bars 18 may also serve the purpose of providing magnetic strips, illustrated at 110 in FIG. 16, or other suitable means for attachment of panels 114 to the front or rear and sides of the framework, as commonly known in the art. Thus, all of the front vertical rows of hubs as well as the rear vertical rows of hubs at the ends of the framework are shown to be connected by mag bars 18. However, it should be understood that only a single mag bar is sufficient for maintaining the framework 10 in the expanded condition in accordance with the present invention.

Figure 15:
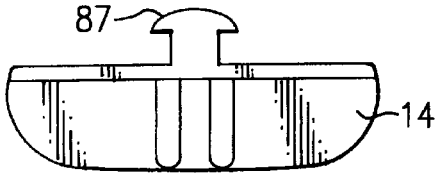
FIG. 15 is a schematic view of a hub for the framework of FIG. 11.

In accordance with the present invention, the uppermost bar portion 19 has an additional hub attachment means, illustrated at 22, which is located about ⅔ of the distance from the top end thereof, and the middle bar portion 20 has an additional hub attachment means, illustrated at 23, which is located about ⅓ of the distance from the top end thereof. The attachment means 22 and 23 as well as hub attachment means 15 on end portions of the bar portions may be any suitable means for attachment detachably to the hubs and can be provided using principles commonly known to those of ordinary skill in the art to which this invention pertains. For example, the hub attachment means may be a recess, such as illustrated at 42 in FIG. 11 of the aforesaid '212 patent, which engages a peg, illustrated at 26 in FIG. 5 of the '212 patent, on the respective hub. This peg or button may be shaped to have a mushroom head, as seen at 87 in FIG. 15, molded directly with the hub. The front face of the hub may have an aesthetically-pleasing knurled or recessed checkerboard pattern. The mag bar portions may be foldably connected together such as illustrated in FIGS. 11 to 13 of the '212 patent or by other suitable means. Thus, the framework may be erected to the full height of perhaps about 8 feet of FIGS. 1 and 2 by expanding it to the full height, then connecting the hub attachment means 15 on the end portions of the bar portions to the hubs. The framework may be erected to the reduced table-top height of perhaps about 5 feet of FIGS. 3 and 4 wherein its height is about ⅔ of its normal full height by expanding or pushing it down to this configuration or allowing it to come down by gravity to this configuration, then attaching the hub attachment means 15 on the upper end portion of the bar portion 19 and the hub attachment means 22 to the upper two hubs 14 respectively and attaching hub attachment means 23 and the hub attachment means 15 on the lower end portion of the middle bar portion 20 to the lower two hubs 14 respectively. The lower bar portion 21, being foldable relative to the middle bar portion, is folded to underlie the framework or otherwise laid so that it is out of the way.

Alternatively, the bar portions 19, 20, and 21 may constitute individual bars which are unattached to each other in which event the lower bar portion 21 would be left out when the framework is erected to the smaller configuration. It should be understood that each bar 18 may comprise any number of connected or individual bar portions depending on the number of quads which the framework has. It should also be understood that, in accordance with the present invention, a single bar portion connecting two hubs may be sufficient to lock the framework in an expanded configuration. Furthermore, the braces 18 may be provided with additional hub attachment means for locking the framework alternately at more than two configurations. Such a system as illustrated in FIGS. 1 to 4 may, for example, be applied to the frameworks of any of the aforesaid patents or of various other frameworks.

Figure 4:
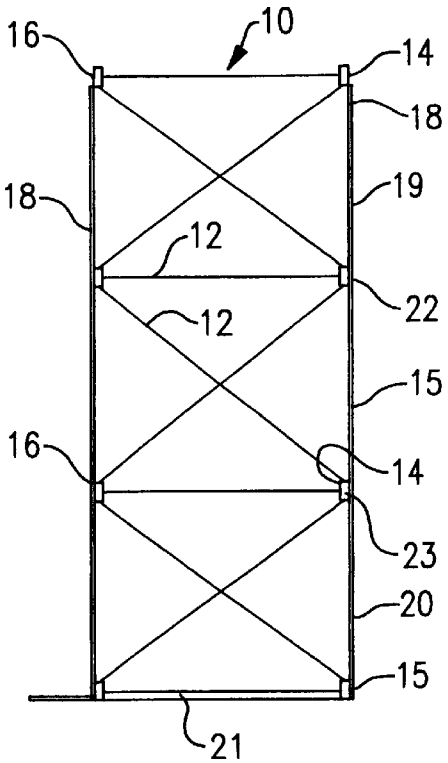
FIG. 4 is a view thereof similar to that of FIG. 2 with the framework in the configuration of FIG. 3.
Figure 3:
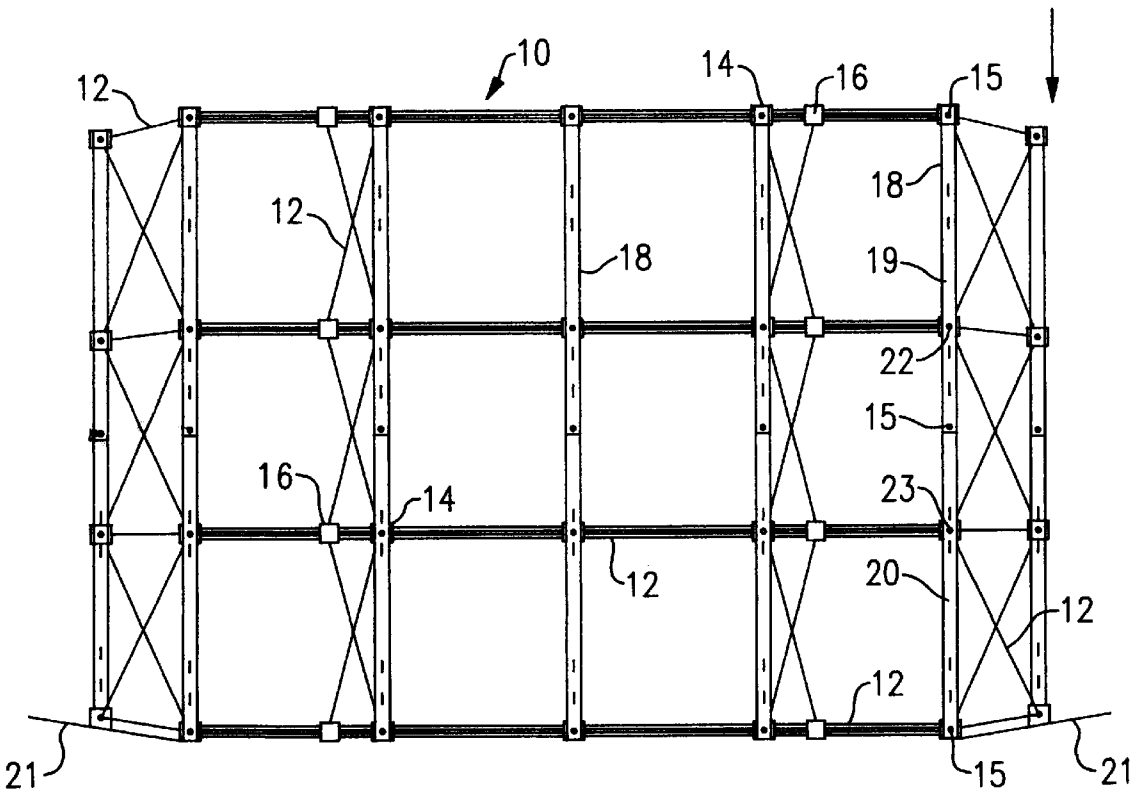
FIG. 3 is a view thereof similar to that of FIG. 1 with the framework erected to a smaller table-top height configuration.
Figure 6:
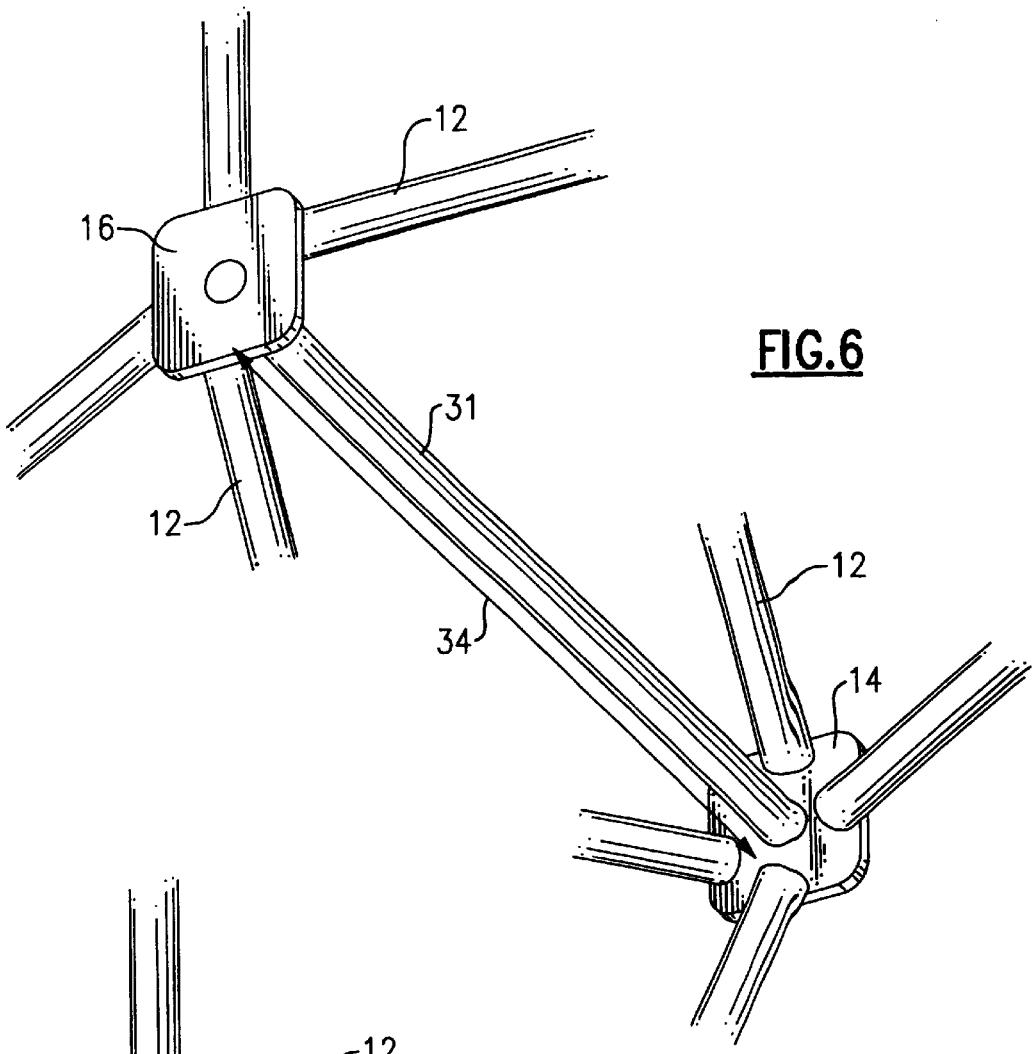
FIG. 6 is a view similar to that of FIG. 5 of the framework of FIG. 5 erected to a reduced height table-top configuration.
Figure 5:
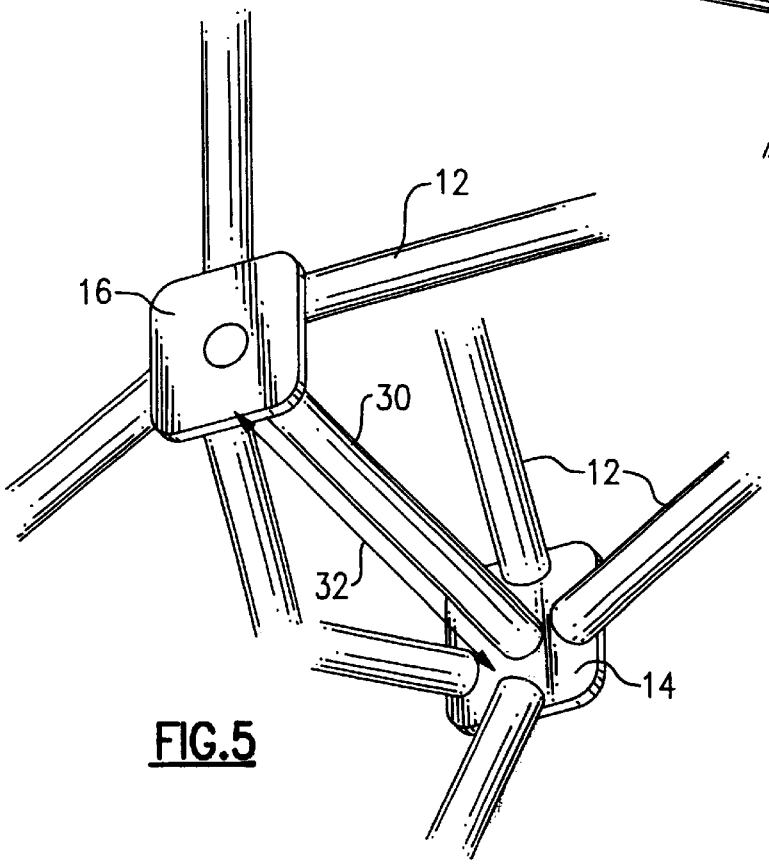
FIG. 5 is a schematic view of a portion of a display framework in accordance with an alternative embodiment of the present invention and which is erected to a full-height configuration.

As seen in FIGS. 2 and 4, the distance between front and rear hubs 14 and 16 respectively increases as the height of the framework decreases. Thus, FIGS. 5 and 6 illustrate the framework at full height and a reduced height respectively. FIG. 5 illustrates an alternative means of holding the framework at the full-height position, i.e., braces or bars 30 (only one shown) which extend between and are detachably attached to corresponding pairs of front and rear hubs 14 and 16 respectively. In order to lock the framework at a reduced-height position, the length of each bar 30 is suitably increased, such as by making the bar telescopingly or otherwise expandable, providing an extension piece, or by substituting a longer bar, illustrated at 31, from the length, illustrated at 32, for the full-height position to the length, illustrated at 34, for the reduced-height position. It should be understood that, in accordance with the present invention, a single set of bars 30 and 31 may be sufficient to lock the framework in either of the expanded configurations. Furthermore, a set of more than two such bars may be provided to lock the framework alternately in more than two configurations. Such a system as illustrated in FIGS. 5 and 6 may, for example, be applied to the frameworks of any of the aforesaid patents or of various other frameworks.

In accordance with another embodiment of the invention, referring to FIGS. 11 to 17, there is illustrated generally at 70 an alternative mag bar extruded from a rigid PVC or other suitable plastic material so that it may desirably have increased flexibility and be manufactured at reduced cost. Mag bar 70 has upper, central, and lower portions 72, 74, and 76 respectively which are hinged together with hinges 78 similarly as shown in FIG. 21 of U.S. Pat. No. 5,483,779 which patent is hereby incorporated herein by reference. The upper end of the upper portion 72 terminates in a reduced diameter portion 80 which is press-fit in a bore 82 in a light holder 84, as seen in FIG. 11, which is suitably connected to the respective upper front hub 14. Elongate hub attachment openings 86 are provided on the mag bar 70 for receiving mushroom-shaped heads 87 on the hubs 14 as well as on hubs 16 when the framework 10 is erected to full height and similar hub attachment openings 88 and 90 are provided in portions 72 and 74 respectively for receiving respective heads 87 when the framework is erected to a partially expanded configuration, similarly as described with reference to FIGS. 1 to 4. Alternatively, the heads 87 may have slots therein in which suitably shaped portions of the mag bars are snap-fitted.

However, mag bar 70 as described, while serving as a panel attachment means, may not be intended to serve also as a brace. At least one of a plurality of light arms 92 (one shown) may be adapted to also serve as a brace to hold the framework at the desired configuration. A light assembly 94 containing perhaps a halogen lamp is mounted to an end of the light arm 92 to slide within a yoke 96 of the holder member 84 and within a yoke 98 of a holder member 100 attached to the rear hub 16 during expanding and collapsing of the framework 10. Suitable spaced enlarged portions or upsets 102 and 104 are provided on each of perhaps 2 of the arms 92 for locking the arm in position at the expanded positions respectively for full and reduced height configurations, thereby locking the framework 10 in the desired configuration. Thus, the yoke 96 is sized to receive the upsets 102 and 104, as seen in FIG. 17. After passage through the yoke, the respective upset drops downwardly to lock the framework at the desired height. There may of course be more than two upsets on a light arm to lock the framework at more than two heights respectively. Suitable fixtures other than lights may similarly be provided on arms which are similarly adapted to lock the framework at a desired height.

Instead of offsets, the light arm may alternatively be provided with spaced reduced-diameter depressions, illustrated at 106, and the light holders 84 provided with upsets 108 on the lower portions of the yokes 96. The depressions 106 "catch" on the upsets 108 respectively for locking the framework in position.

Referring to FIG. 16, the front face of each portion of the mag bar 70 has two side-by-side recesses in which may be contained a pair of flexible magnets 110 engageable by magnets 112 on panels 114 for connection thereof to the framework.

Figure 7:
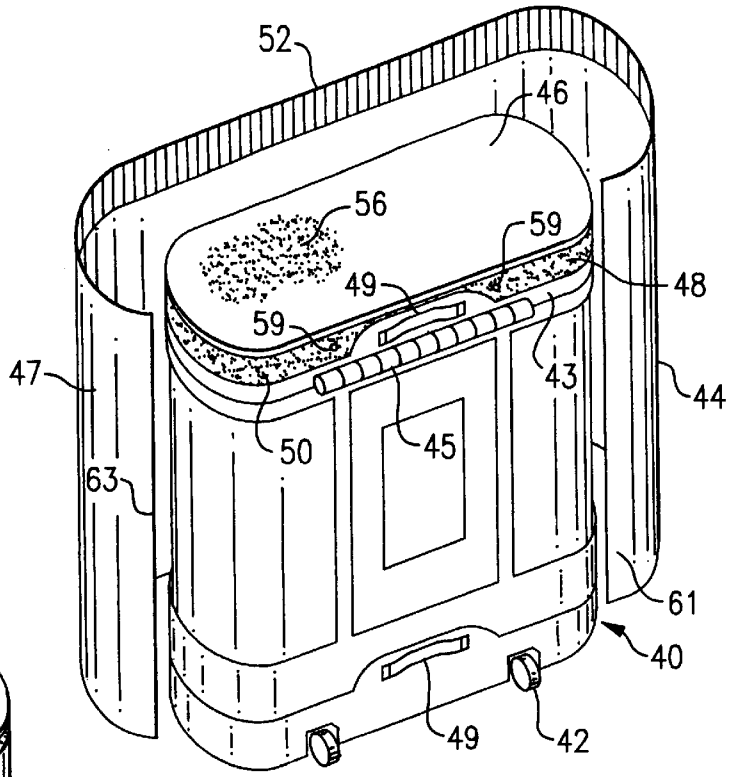
FIG. 7 is a perspective view of a shipping case and wrap panel which embodies the present invention, the wrap panel being illustrated in position to be applied to the case.

Referring to FIG. 7, there is illustrated generally at 40 a molded shipping case having a pair of rear wheels 42 for housing all of the components for the convertible pop-up display 10 including the framework, full-size panels, smaller-size panels, endcaps, lighting, and panel attachment bars. The case has a lid 43 hingedly connected to the body of the case by hinge 45 for opening the case for receiving and for stowing the components. The lid 43 has an upper platform 46 providing an upper surface 56 upon which papers, literature, or the like may be placed when the case is used as a podium. The case 40 also has upper and lower handles 49 on its rear side and a leveling bar 51 on its front side.

Figure 8:
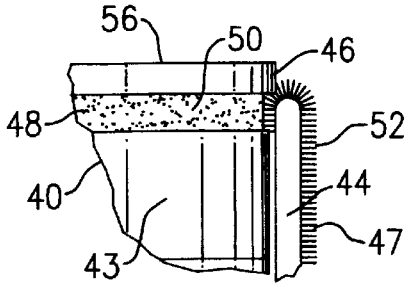
FIG. 8 is a detail view thereof illustrating attachment of the wrap panel to the case.
Figure 14:
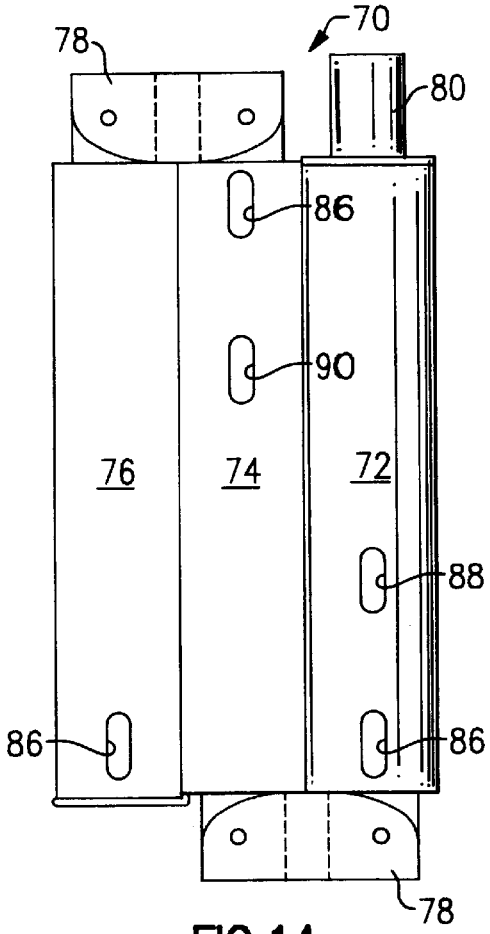
FIG. 14 is a schematic view of a mag bar for the framework of FIG. 11, illustrated in a folded configuration for stowage in the case.

In accordance with the present invention, the shipping case 40 is convertible to a freestanding podium/counter unit by attaching a one-piece flexible fabric wrap or panel 44 around the sides or perimeter. The upper edge of the fabric covered wrap 44 abuts the platform 46 so that it is flush therewith for a pleasing appearance, as seen in FIG. 8. For the purposes of this specification and the claims, the term "flush" is meant to refer to an abutting relationship between the platform 46 and panel 44 to form an unbroken view of the platform with the panel extending downwardly therefrom. The wrap 44, which is composed of, for example, PVC, Lexan plastic, or other suitably flexible material, is also housed in the case 40 for shipment and stowage. A recess, illustrated at 48, extends about the case 40 just below and adjacent the platform 46. A continuous strip of hook-type fastener material 50, commonly known as Velcro material, which may be self-adhesive, is adhesively attached therein. Rivets 59, spaced along the length of the recess 48, or other suitable mechanical attachment means may also attach the fastener material 50 to the case to further assure a positive permanent bond therebetween.

Decorative fabric material, illustrated at 52, is provided along the upper edge portion of the wrap 44 on the inner as well as outer side thereof for attachment to Velcro material 50 and extends over the entirety of the outer side 47 thereof. A strip of hook-type fastener or Velcro material 60 is provided on the inner side of an end edge portion 61 of the wrap for attachment thereof to the cloth material on the other end edge portion 63 along the case rear. The wrap 44 is thus provided to cover and provide a pleasing appearance over the entire front, sides, and rear of the case 40 from flush with the platform 46 downwardly.

Alternatively, the wrap 44 may be covered with another suitable decorative graphics material. If such a material is not suitable for attachment of the Velcro strip 50, then a separate strip of fabric or other suitable material may be placed along the upper inner edge of the wrap 44 for engagement with the Velcro strip.

The case upper surface 56, which is suitably decoratively textured, acts as the counter top thereby eliminating the need for an actual separate top to be placed on the case. The single-piece wrap 44 is thus provided to easily and quickly convert the case into a freestanding podium/counter.

It should be understood that the invention can be embodied otherwise than as described herein without departing from the principles thereof For example, other frameworks, currently existing or developed in the future, may have means other than those described herein for holding them in an expanded position, and suitable alternative embodiments may be provided for converting the frameworks between configurations of at least two different erected heights. Such other embodiments are meant to come within the scope of the present invention as defined by the appended claims.

What is claimed is:

1. A podium convertible from a shipping case, the podium comprising a container having a bottom wall, a vertical wall, an upper platform defining a work surface, a decorative panel for extending about the container, and means for detachably fastening said decorative panel to said container to be flush with said platform.

2. A podium according to claim 1 wherein said fastening means comprises defining an elongate recess in said vertical wall means which is adjacent and extends along the periphery of said platform and fastener material in said recess means for engaging said decorative panel.

3. A podium according to claim 2 further comprising material decoratively covering an outer side of said panel and covering an inner side of said panel along an upper edge portion thereof for engaging said fastener material.

4. A podium according to claim 2 wherein said fastener material comprises hook-type fastening material.

5. A podium according to claim 1 wherein said decorative panel has a length to extend entirely about said container between a pair of edge portions and includes means for detachably fastening the edge portions together.

6. A podium according to claim 5 wherein said edge portions fastening means comprises hook-type fastening material on one of said edge portions of said decorative panel.

7. A podium according to claim 1 in combination with a framework for mounting displays which framework is collapsible for stowage within said container.

8. A shipping case convertible to a podium, the shipping case comprising a container having a bottom wall, a vertical wall, an upper platform defining a work surface, means defining an elongate recess in said vertical wall which is adjacent and extends along the periphery of said platform, and means in said recess means for detachably fastening a decorative panel to said container.

9. A shipping case according to claim 8 wherein said fastening means comprises hook-type fastening material.

10. A shipping case according to claim 8 in combination with a framework for mounting displays which framework is collapsible for stowage within said container.

11. A method of converting a shipping case to a podium, the method comprising wrapping a decorative panel about the shipping case while detachably attaching the decorative panel to the shipping case to be flush with an upper platform thereof.

12. A method according to claim 11 wherein the step of attaching comprises engaging an upper edge portion of said panel to fastening material in an elongate recess in the case which is adjacent and extends along the periphery of the platform.

13. A method according to claim 12 further comprising selecting the decorative panel to have material on said upper edge portion for engaging said fastening material on the shipping case and decoratively extending over an outer side of the panel.

* * * * *

UNITED STATES PATENT AND TRADEMARK OFFICE

CERTIFICATE OF CORRECTION

PATENT NO. : 6,189,700 B1
DATED : February 20, 2001
INVENTOR(S) : Packrall et al.

It is certified that error appears in the above-identified patent and that said Letters Patent is hereby corrected as shown below:

Column 6,
Line 28 - after "comprises", insert --means--.
Line 29 - after "wall", delete --means--.

Signed and Sealed this

Seventh Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,189,700 B1
DATED : February 20, 2001
INVENTOR(S) : Packrall et al.

It is certified that error appears in the above-identified patent and that said Letters Patent is hereby corrected as shown below:

Title page,
Item [22], Filed: Dec. 20, 1996", insert the following:

-- Related U.S. Application Data
[60] Provisional application No. 60/009,560, filed on January 3, 1996. --

Signed and Sealed this

Twenty-third Day of July, 2002

*Attest:*

*Attesting Officer*

JAMES E. ROGAN
*Director of the United States Patent and Trademark Office*